US012251645B2

(12) United States Patent
Joshi et al.

(10) Patent No.: US 12,251,645 B2
(45) Date of Patent: Mar. 18, 2025

(54) POWER HUB FOR INTERLOCKING BRICKS

(71) Applicant: Niyam8, Pleasanton, CA (US)

(72) Inventors: Vrinda Joshi, Pleasanton, CA (US); Daniela Boccoleri, Seattle, WA (US)

(73) Assignee: NIYAM8, Pleasanton, CA (US)

( * ) Notice: Subject to any disclaimer, the term of this patent is extended or adjusted under 35 U.S.C. 154(b) by 150 days.

(21) Appl. No.: 18/046,649

(22) Filed: Oct. 14, 2022

(65) Prior Publication Data

US 2024/0123366 A1 Apr. 18, 2024

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/086; A63H 33/088
See application file for complete search history.

(56) References Cited

U.S. PATENT DOCUMENTS 4,813,903 A * 3/1989 Furukawa ..... A63H 33/042 446/104
5,378,184 A * 1/1995 Bro ..... A63H 3/16 446/99
5,411,428 A * 5/1995 Orii ..... A63H 33/042 446/128
5,683,283 A * 11/1997 Glynn ..... A63H 33/086 446/128
5,738,558 A * 4/1998 Zimmer ..... A63H 33/042 446/90
5,779,515 A * 7/1998 Chung ..... A63H 33/04 446/90
5,938,498 A * 8/1999 Glynn ..... A63H 33/10 446/124
6,939,192 B1 * 9/2005 Munch ..... A63H 30/04 446/436
7,708,615 B2 * 5/2010 Munch ..... A63H 33/042 446/484
8,753,164 B2 * 6/2014 Hansen ..... A63H 33/042 446/85
9,320,980 B2 * 4/2016 Schweikardt ..... A63H 33/046
10,625,173 B2 * 4/2020 Kærsgaard ..... A63H 33/086
(Continued)

FOREIGN PATENT DOCUMENTS

CN 109794930 A * 5/2019
EP 0124237 A1 * 11/1984

OTHER PUBLICATIONS

Translation CN109794930A (Year: 2019).*

*Primary Examiner* — Eugene L Kim
*Assistant Examiner* — Alyssa M Hylinski
(74) *Attorney, Agent, or Firm* — NGUYEN TARBET IP LAW

(57) ABSTRACT

An integrated power hub with a rotating driveshaft allows for the transformation of interlocking building blocks into a moving model. Blocks may be attached in many different combinations and configurations to any or all of 6 buildable surfaces of the power hub. A motor and a battery may both be safely integrated within the power hub such that the single unit may be used without the need for additional wires. Numbered studs on one or more of the building surfaces may facilitate clear instructions for young users.

1 Claim, 14 Drawing Sheets

(56) References Cited

U.S. PATENT DOCUMENTS

| | | | | |
|---|---|---|---|---|
| 11,845,014 | B2 * | 12/2023 | Ma | A63H 33/086 |
| 2003/0038607 | A1 * | 2/2003 | Yim | B25J 9/08 318/568.11 |
| 2009/0298382 | A1 * | 12/2009 | Ochi | A63H 33/062 446/121 |
| 2012/0122059 | A1 * | 5/2012 | Schweikardt | G09B 23/00 434/118 |
| 2016/0339351 | A1 * | 11/2016 | Akishbekov | A63H 33/086 |
| 2016/0361662 | A1 * | 12/2016 | Karunaratne | G06F 3/038 |
| 2017/0173485 | A1 * | 6/2017 | Liotta | A63H 33/042 |
| 2018/0193998 | A1 * | 7/2018 | Shin | B25J 19/005 |
| 2018/0353871 | A1 * | 12/2018 | Oschuetz | B25J 9/08 |
| 2019/0232185 | A1 * | 8/2019 | Lin | A63H 33/086 |
| 2019/0299113 | A1 * | 10/2019 | Lee | A63H 33/086 |
| 2021/0252701 | A1 * | 8/2021 | Yim | G05B 19/0426 |
| 2021/0299857 | A1 * | 9/2021 | Woo | B25J 9/08 |
| 2021/0343185 | A1 * | 11/2021 | Wang | G09B 23/183 |

* cited by examiner

POWER HUB FOR INTERLOCKING BRICKS

FIELD OF THE INVENTION

The present invention relates to a hub for powering movement of structures built from interlocking bricks.

BACKGROUND OF THE INVENTION

Interlocking toy bricks have long inspired creativity and facilitated the building of unique creations ranging from the simple to the very complex. Dynamic models have been built by the connection of the interlocking toy bricks with electric motors. Previous designs of such robotic toys which have allowed for the creation of moving models have been deficient in the following respects:

First, previous designs have included batteries and motors as separate units, thereby necessitating connecting cables which may be unsuitable for younger users. Separating motor and battery also presents the risk of poor connectivity after frequent usage, increases component count and can result in limitations in the scope of application designs.

Second, previous designs have lacked indicator lights to show the battery charge levels, or have placed such an indicator light in a location where it would likely be covered by bricks built onto the unit, such that it would not be visible in many use scenarios.

Third, previous designs had few buildable surfaces, limiting application designs and therefore the scalability and versatility and the playing life duration for the user.

Fourth, previous designs lacked a low battery indicator, which is a critical factor in troubleshooting motor performance issues.

Fifth, previous designs did not have product-product mating capability to allow multiple products connected using building blocks to work separately or in tandem.

Sixth, previous designs lacked a supporting gallery of application designs to provide additional inspiration and enrichment.

BRIEF SUMMARY OF THE INVENTION

It is an objective of the present invention to provide systems and devices that allow for the transformation of interlocking building blocks into moving models, as specified in the independent claims. Embodiments of the invention are given in the dependent claims. Embodiments of the present invention can be freely combined with each other if they are not mutually exclusive.

In some embodiments, the present invention features an integrated power hub configured to transform interlocking building bricks into a moving model by the attachment of different combinations of the bricks to any of the hub's six buildable surfaces. The hub allows for the reuse of popular, easily available, building block to provide an opportunity to learn through play, and a wide range of application designs enables the product to grow with a child user.

One of the unique and inventive technical features of the present invention is the inclusion of six independent building surfaces on an integrated power hub. Without wishing to limit the invention to any theory or mechanism, it is believed that the technical feature of the present invention advantageously provides for the construction of a huge variety of moving models without connecting wires or complex controls. None of the presently known prior references or work has the unique inventive technical feature of the present invention. The lack of electrical component integration in previous designs sharply contrasts with the present invention's safe integration of electrical components such as a motor and a battery within an integrated power hub. This integration allows for a reduction of the total number of cords and wires which are required, for example, by eliminating any external connection wire between a battery and a motor.

While previous designs lacked a low battery indicator, or positioned any battery indicator light in a position likely to be covered in a build, embodiments of the present invention position an indicator light ring such that it allows for visual inspection of the battery level even when bricks are positioned on all building surfaces of the hub.

While previous designs had few building surfaces, embodiments of the present invention include multiple buildable surfaces, for example, on all six faces of a cube. Additionally, embodiments of the present invention provide numbered studs to enable easier attachment of building blocks and the creation of easy-to-follow learning avenues for younger users.

While previous designs often require proprietary elements, or complex technologies to build or control the moving models, embodiments of the present invention may be used independently of complex technologies like Bluetooth pairing, and may be versatile enough for use in a variety of environments such as homes, schools, and enrichment classes. For example, embodiments of the present invention may use and reuse popular, readily available building blocks that a home, school, or classroom already has. Additionally, while previous designs lack easily accessible application designs for a wide range of ages, selected embodiments of the present invention include a range of application designs with detailed instructions readily available.

Furthermore, the prior references teach away from the present invention. For example:

1) Prior designs have minimal building surfaces with studs as the sole means of attaching interlocking bricks.
2) Prior designs lack a clearly visible low battery indicator that can affect motor performance
3) The industry teaching is that robotics batteries and motors should be kept as separate components so as to allow for better thermal transfer from each of the separate units. There is a teaching in the field that placement of a battery and a motor within a single unit may cause overheating.
4) Prior designs rely on wired or wireless technology for communication in order to control the product.
5) Prior designs do not have the capability of multiple products being controlled by one switch.
6) Prior designs are not designed to be have the capability of building on multiple axis.
7) Prior designs do not have any numbered studs anywhere on the product.

Furthermore, the inventive technical feature of the present invention contributed to a surprising result. For example:

1) While including studs on a sliding switch was expected to allow for building on that face of the cube, it also provided the unexpected benefit of allowing multiple switches on multiple hubs to be easily connected together such that a single action may control the multiple hubs.
2) While multiple surfaces were built in order to provide more opportunities for building, it also provided the unexpected result of the surfaces being customizable/ interchangeable during manufacturing to allow interlocking bricks from multiple third party vendors to be used.

3) While the shape was designed primarily to be compact for a young learner and fit into a user's hand, it had the unexpected result of allowing for bricks to be stacked parallelly, perpendicularly or laterally.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWINGS

The features and advantages of the present invention will become apparent from a consideration of the following detailed description presented in connection with the accompanying drawings in which.

DETAILED DESCRIPTION OF THE INVENTION

Figure 1:
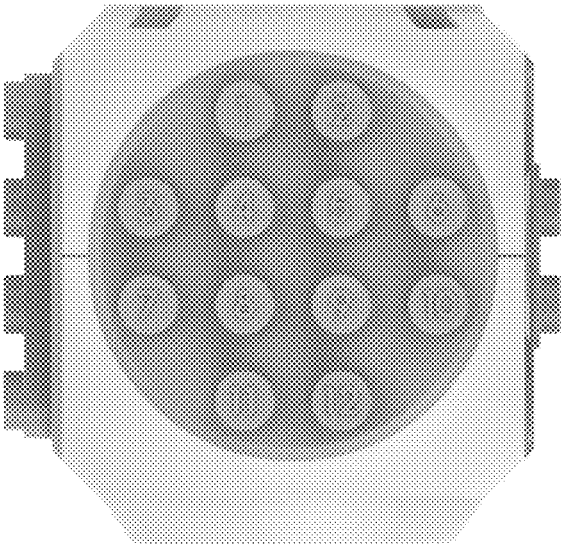
FIG. 1 shows a first face of a power hub of the present invention, having twelve numbered studs (1 to 12) arranged in a cross pattern.
Figure 2:
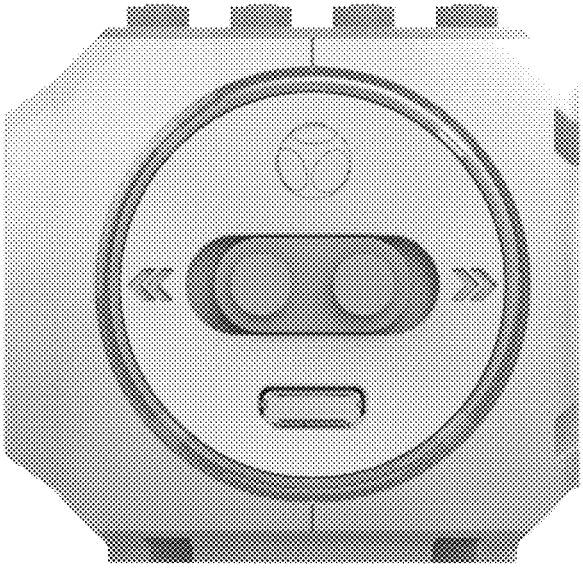
FIG. 2 shows a second face of a power hub of the present invention, having a control switch with two studs, an indicator light, and a charging port.
Figure 3:
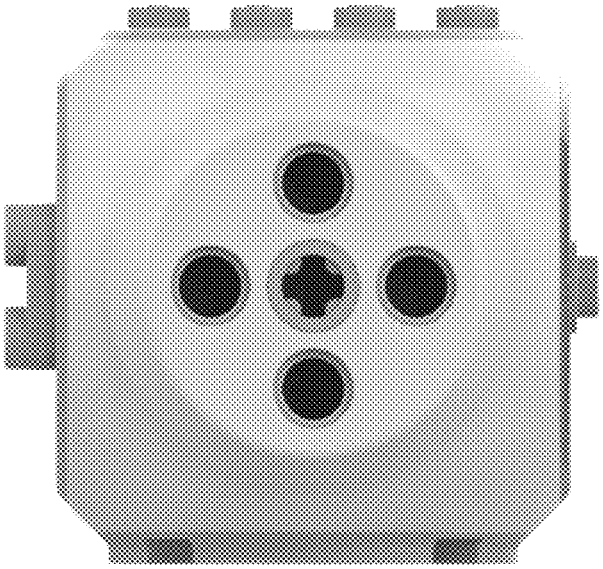
FIG. 3 shows a third face of a power hub of the present invention, having an internal driveshaft surrounded by four pin holes. The pin hole are arranged in a cross pattern around the driveshaft.
Figure 4:
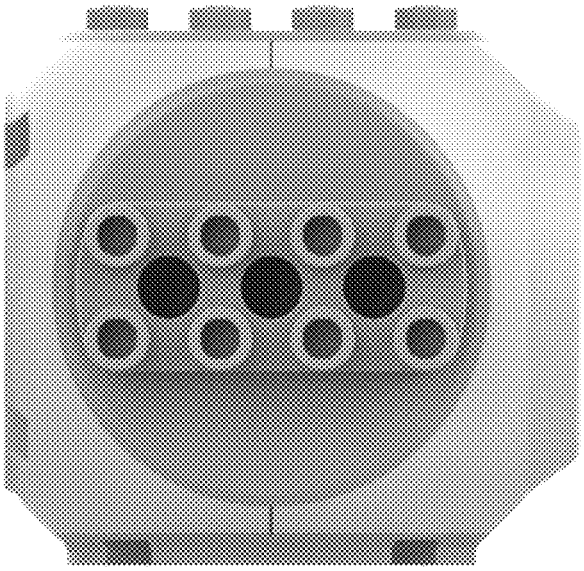
FIG. 4 shows a fourth face of a power hub of the present invention, having eight hollow studs arranged in two rows of four, surrounding three pin holes.
Figure 5:
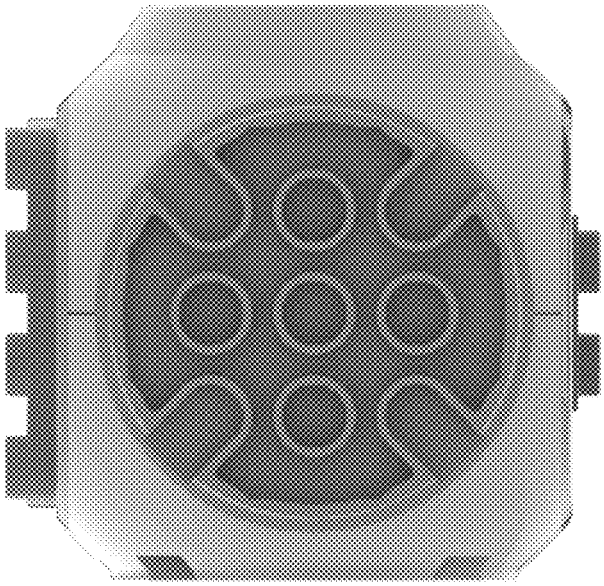
FIG. 5 shows a fifth face of a power hub of the present invention, having five anti-studs arranged in a cross pattern, surrounded by four partial anti-studs to form a grid of nine complete and partial anti-studs.
Figure 6:
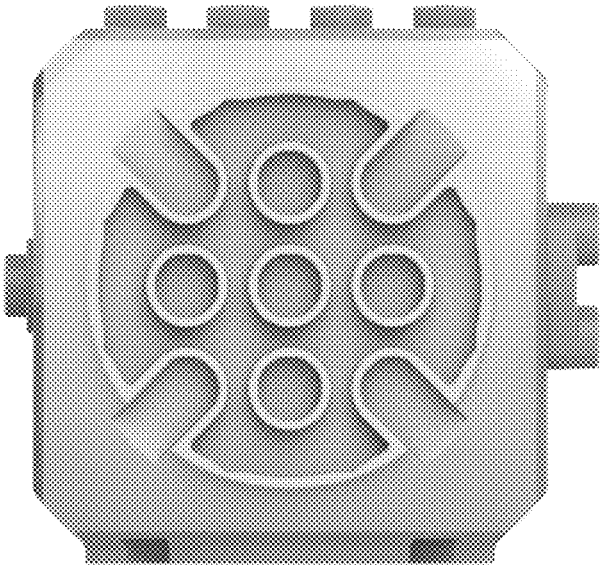
FIG. 6 shows a sixth face of a power hub of the present invention, having five anti-studs arranged in a cross pattern, surrounded by four partial anti-studs to form a grid of nine complete and partial anti-studs.
Figure 7:
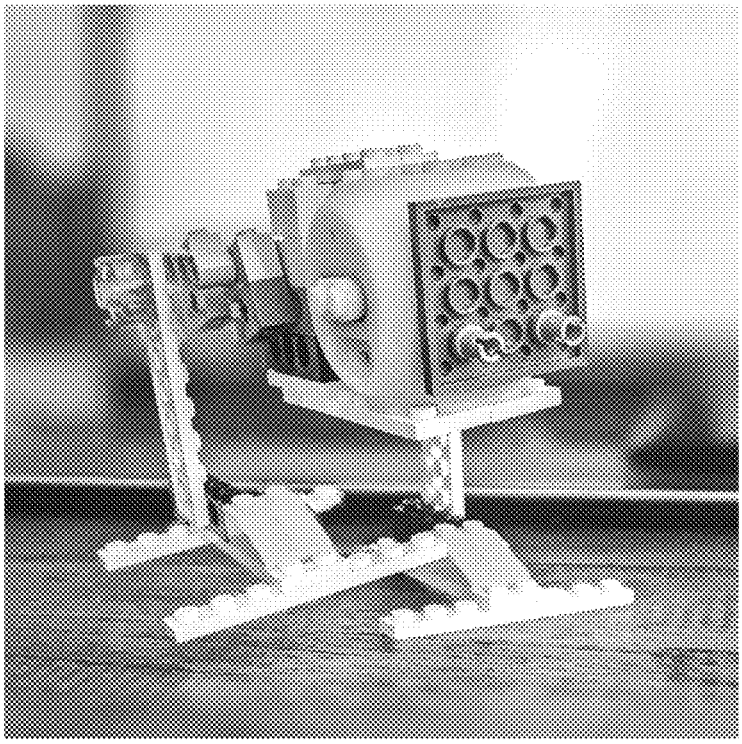
FIG. 7 shows an example of a dynamic model created using a power hub of present invention and a plurality of interlocking bricks. This model is designed such that the driveshaft of the power hub is coupled with two legs, such that rotation of the driveshaft by the motor is configured to mimic walking by actuating each of the legs. This model teaches the simple machine concept crank whereby linked beams or rods are used to change circular (rotational) motion from the motor to a back and forth (linear) motion.
Figure 8:
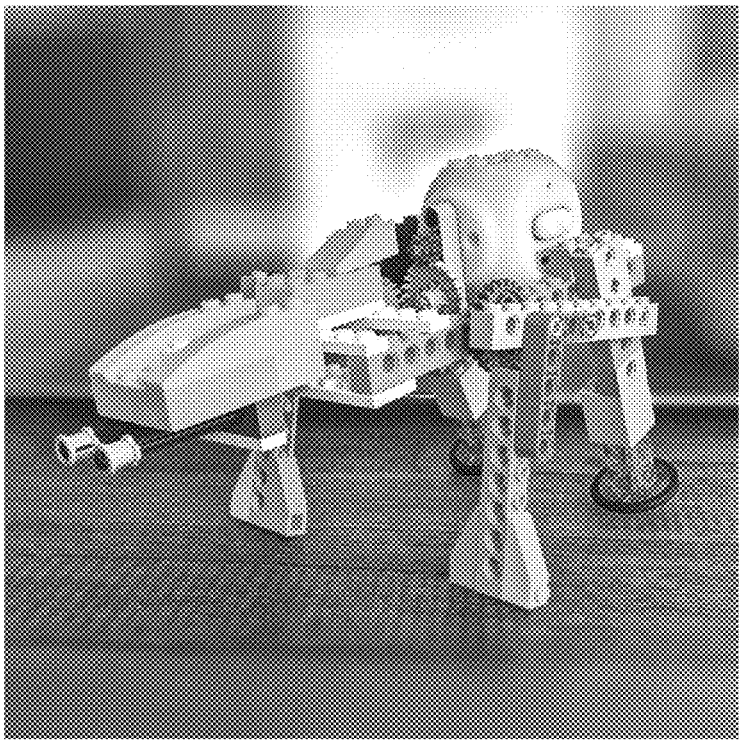
FIG. 8 shows an example of a dynamic model created using a power hub of present invention and a plurality of interlocking bricks. This model is designed such that the driveshaft of the power hub is connected to gears that are arranged at right angles such that two connecting gears are coupled with two beams that in turn connect to four legs Rotation of the driveshaft turn each gear which causes the attached beams to move back and forth in a crankshaft motion and mimic walking by actuating each leg. This model teaches multiple simple machine concepts—a crank, whereby linked beams or rods are used to change circular (rotational) motion from the motor to a back and forth (linear) motion and a crown gear which has curved teeth that can mesh with other gears at a right angle, instead of side by side, changing the direction of motion.
Figure 9:
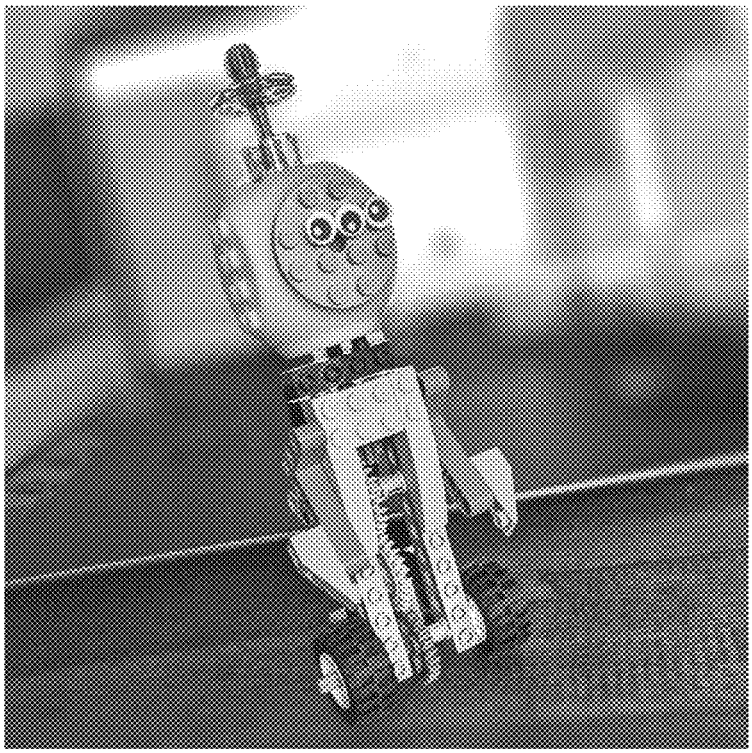
FIG. 9 shows an example of a dynamic model created using a power hub of present invention and a plurality of interlocking bricks. The model is designed such that the driveshaft of the hub is connected to a gear train of connected gears which in turn are connected to two wheels that rotate, thus enabling a rolling movement forward or backward. Additionally, linked bricks connected to the middle gear mimic the functionality of a cam gear which in turn actuates the arms in a upward direction. This model teaches multiple simple machine concepts—gear ratio (Gears of different sizes when connected have different outcomes/effects), gear train (Two or more gears in conjunction with each other) and a cam (sliding piece—usually elliptical in shape used to transform rotary motion to a linear motion).
Figure 10:
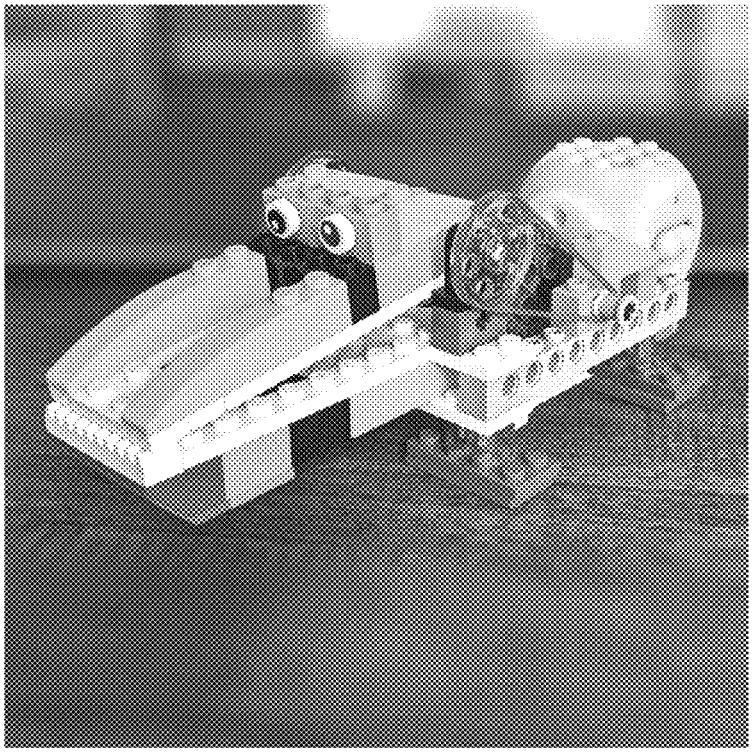
FIG. 10 shows another example of a dynamic model created using a power hub of the present invention and a plurality of interlocking bricks. This model is designed such that the driveshaft is connected by means of gears to interlocking bricks that mimic the opening and closing movement of a jaw using a rubber band. This model teaches the pulley simple machine concept whereby two circular elements connected with the rubber band rotate in tandem.
Figure 11:
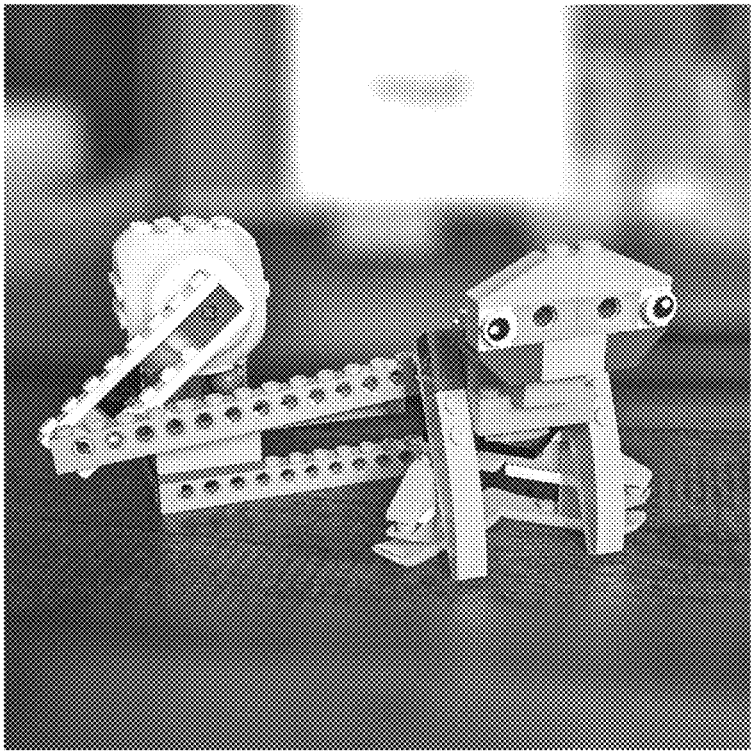
FIG. 11 shows another example of a dynamic model created using a power hub of the present invention and a plurality of interlocking bricks. This model is designed such to demonstrate how a side-to-side movement can be achieved by connecting interlocking bricks to the driveshaft and motor to create a crankshaft. This model teaches the simple machine concept crank, which is a system of two beams linked in such that the rotational movement of one beam causes the lateral movement of the second.
Figure 12:
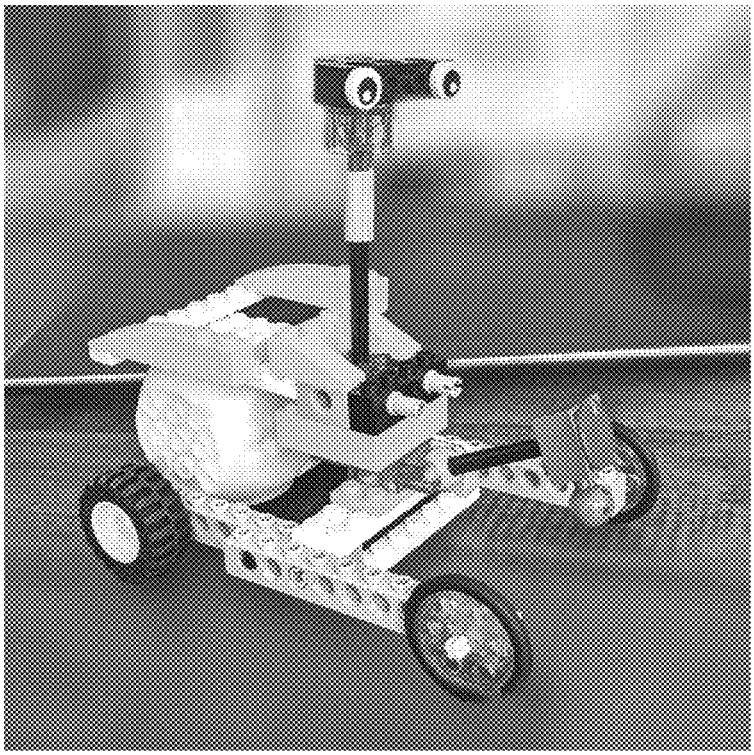
FIG. 12 shows an example of a dynamic model created using a power hub of the present invention and a plurality of interlocking bricks. This model is designed to mimic the rolling motion of an automobile using gears. This model teaches the simple machine concept of gears and gear ration, using gears of two different sizes, one of which is connected to the driveshaft, to turn the rear wheels. The design also makes use of linked beams to stabilize the structure and provide friction and movement of the front wheels so that the model moves forward and backward.
Figure 13:
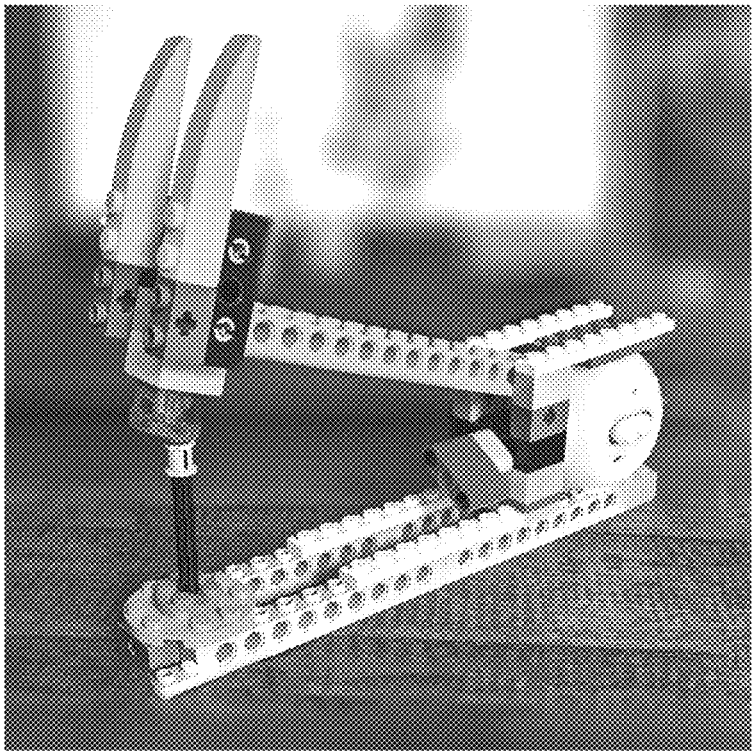
FIG. 13 shows an example of a dynamic model created using a power hub of the present invention and a plurality of interlocking bricks. This model is designed to mimic the vertical motion of a hammer. This model teaches the simple machine concept of using a cam (a sliding piece, usually elliptical in shape used to transform rotary motion to a linear motion) to move the arm of the hammer vertically.
Figure 14:
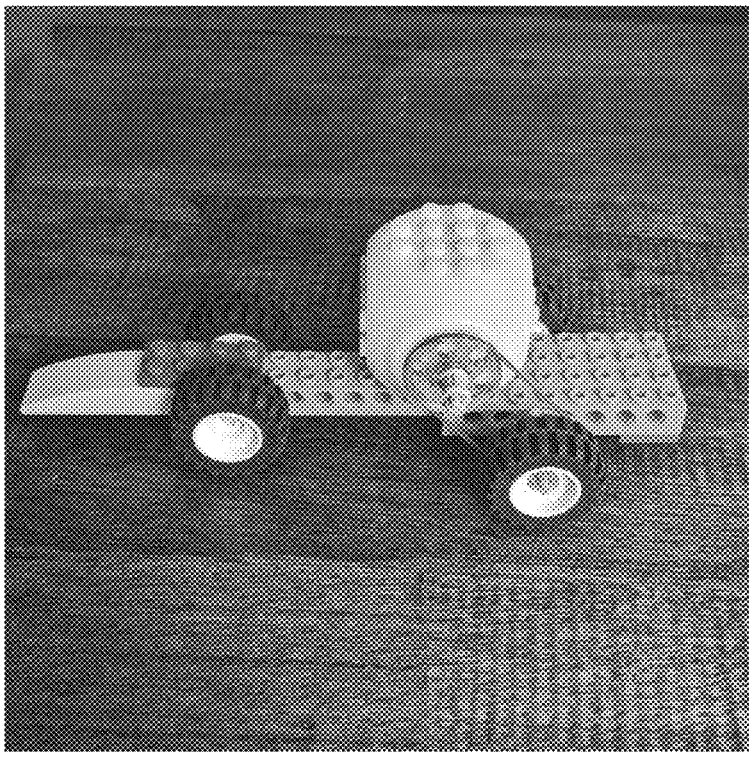
FIG. 14 shows an example of a dynamic model created using a power hub of the present invention and a plurality of interlocking bricks to create an application design of a small car. The model teaches the simple machine concept of pulleys—two wheels connected with a belt that enables one wheel to move when the other wheel is turned by the driveshaft and motor. Rear wheels are on the same axle which allows simultaneous movement thus propelling the car forward.
Figure 15:
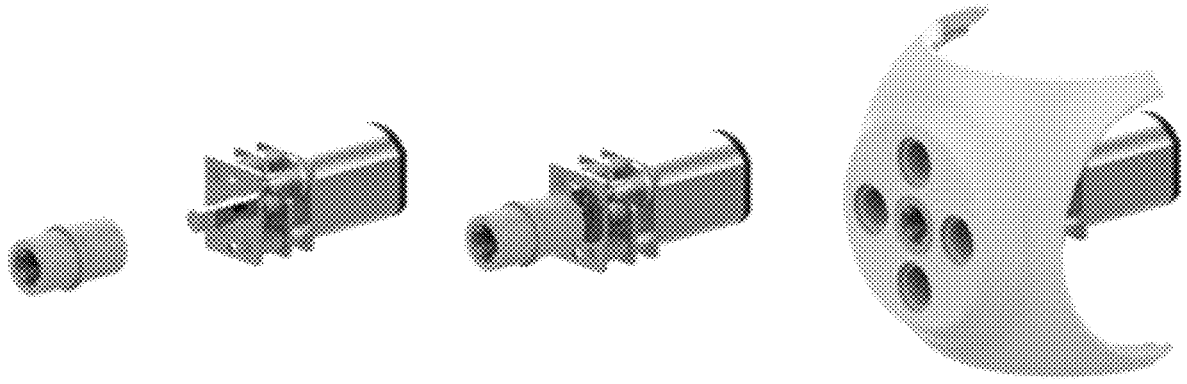
FIG. 15 shows an electric motor coupled with a driveshaft of a power hub. The custom driveshaft was designed for a 3V motor and placed internally and orthogonally to the third face.
Figure 16:
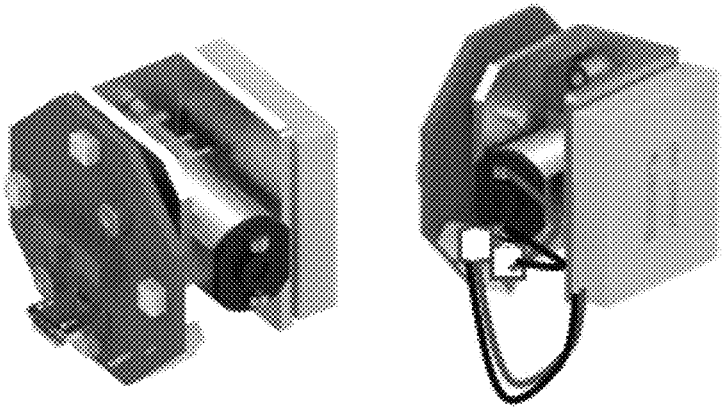
FIG. 16 shows a battery electrically coupled with a motor.

Referring now to FIGS. 1-14, the present invention features a power hub for use with interlocking bricks. As a non-limiting example, the hub may comprise a six-faced, or cuboid housing. In other embodiments, the hub may comprise a housing with more than six faces. In some embodiments, the housing may comprise a cube or a rounded cube (e.g. a spherocube or spherical surface). In preferred embodiments, the housing may have rounded edges and may be sized to fit well within a child's hand. A cuboid housing of the present invention may comprise a first face, disposed at a top of the housing; a second face, disposed at a side of the housing such that it is perpendicular with the first face; a third face at a side of the housing such that it is perpendicular with the first face and the second face, a fourth face at a side of the housing such that it is perpendicular with the first face and the third face, and parallel with the second face; a fifth face at a side of the housing such that it is perpendicular with the first face, the second face, and the fourth face, and parallel with the third face; and a sixth face, disposed at a bottom of the housing such that it is perpendicular with the second face, the third face, the fourth face, and the fifth face, and parallel with the first face.

One or more of the faces (e.g. the first face) may comprise a plurality of studs configured to interlock with interlocking bricks. For example, each of the studs may be sized so as to fit exactly within an anti-stud of an interlocking brick. Similarly, one or more of the faces (e.g. the fifth and sixth faces) may comprise a plurality of anti-studs configured to interlock with interlocking bricks. A face with studs may be referred to as having a positive building surface, and a face with anti-studs may be referred to as having a negative building surface. In some embodiments, a single face may include both positive and negative building surfaces. Additionally, one or more of the faces (e.g. the third and fourth faces) may comprise a plurality of pin hole configured to receive connecting pins. A face with pin holes may be referred to as having a pin building surface. In some embodiments, a single surface may be both a positive building surface and a pin building surface, or both a negative building surface and a pin building surface. In selected embodiments, one or more of the faces may be easily removed and swapped with a face having a different type of building surface. In other embodiments, each of the faces may be designed to be permanently fixed.

In some embodiments, one or more of the studs may be a hollow stud (e.g. a Lego® Technic™ stud) configured to receive a mini-stud, and one or more of the negative surfaces may include one or more mini-studs configured to fit within a hollow stud (e.g. a Lego® Technic™ stud). Use of such hollow studs and mini-studs may allow for the interlocking of the hub with interlocking components (e.g. Lego® Technic™ components) such that the components are attached to the hub in an offset manner.

One or more of the faces (e.g. the second face) may comprise a control switch. As a non-limiting example, a switch may be electrically coupled with both a motor and a battery such that the switch is configured to control operation of the motor. In some embodiments, a switch may have two, three or more positions. As a non-limiting example, the switch may be a Center OFF 2 position slide switch. As another non-limiting example, three positions may correspond to no rotation, clockwise rotation, and counter-clockwise rotation. Additional switches may toggle rotation speed or intermittency. As a non-limiting example, an intermittency switch may have a first position corresponding to continuous rotation, a second position corresponding to alternating 10 second rotation and 2 second rest periods, and a third position corresponding to alternating 1 second rotation and 5 second rest periods. In some embodiments, one or more of the faces (e.g. the second face) may comprise a control switch cap, an indicator light, and a USB receiver configured to allow the power hub to be plugged into a charging cord.

One or more of the faces (e.g. the third face) may comprises one or more internal or external driveshafts. In some embodiments, one or more of the driveshafts may be orthogonal to the respective face it is disposed through. In one embodiment, a hub may have a single driveshaft accessible through a single face. In another embodiment, a hub may have a single driveshaft accessible through two opposite faces. In another embodiment, a hub may have multiple driveshafts accessible through a single or through multiple faces. Each of the driveshafts may be separately controlled, or multiple driveshafts may be simultaneously controlled via one or more controls.

In preferred embodiments, the hub may include one or more electric motors, each disposed inside the housing and mechanically coupled with one or more driveshafts such that the motor is configured to cause rotation of the one or more driveshafts. As a non-limiting example, the motor may be a 3-volt motor, capable of 75 revolutions per minute. As another non-limiting example, the motor may be a 6-volt motor, capable of 60 revolutions per minute. In some embodiments, one of more of the motors may be configured for bidirectional rotation.

In some embodiments, the hub may also include one or more internal batteries, disposed inside the housing and electrically coupled with one or more motors such that the one or more batteries are configured to power the one or more motors. Inclusion of one or more batteries may allow the hub to be configured for cordless operation. In some embodiments, one or more of the faces may comprise a charging port configured to allow for a wired connection to recharge the one or more batteries. As a non-limiting example one or more of the internal batteries may be rechargeable lithium-ion batteries.

In one example embodiment, a hub may comprise a fourth face having a plurality of studs, and fifth and sixth faces each having a plurality of anti-studs. The first face may have 12 studs arranged in a cross pattern. The third face may have 4 pin holes arranged surrounding the driveshaft. The fourth face may have 8 studs arranged in two rows of four and surrounding 3 pin holes, such that the fourth face is configured to receive both interlocking bricks and pins. The fifth and/or sixth faces may have 5 anti-studs arranged in a cross pattern.

As a non-limiting example of the present invention, a power hub for use with interlocking bricks may comprise: a multifaceted housing; a driveshaft disposed through a face of the housing such that it is orthogonal to the face; an electric motor, disposed within the housing and mechanically coupled with the driveshaft such that the motor is configured to cause rotation of the driveshaft; an internal battery disposed inside the housing and electrically coupled with the motor such that the battery is configured to power the motor; and a slidable switch disposed on a face of the housing and electrically coupled with both the motor and the battery such that the switch is configured to control operation of the motor. According to some preferred embodiments, a switch cap may comprise one or more studs or anti-studs configured to interlock with one or more interlocking bricks, thereby allowing the implementation of a switch control system constructed from interlocking bricks.

In some embodiments, the switch cap may comprise at least two studs or anti-studs. In selected embodiments, the switch control system may be configured to simultaneously control a plurality of power hubs. In some embodiments, one or more faces of the housing may comprise an indicator light. The indicator light may preferably be positioned such that it is visible even when the hub is interlocked with a plurality of interlocking bricks.

As another non-limiting example of the present invention, a power hub for use with interlocking bricks may comprise: a multifaceted housing; a driveshaft disposed through a face of the housing such that it is orthogonal to the face; an electric motor, disposed within the housing and mechanically coupled with the driveshaft such that the motor is configured to cause rotation of the driveshaft; an internal battery disposed inside the housing and electrically coupled with the motor such that the battery is configured to power the motor; where at least one face of the housing comprises a plurality of sequentially numbered studs. As a non-limiting example, the numbering of the studs may correspond to numbering in building instructions. The power hub may comprise a power or other control switch on one of the faces of the housing. In some embodiments, the hub may comprise a communication module (e.g. including a Bluetooth antenna) configured to allow for wireless control of the motor. In preferred embodiments, the driveshaft may be configured to receive an axle such that the axle would extend orthogonally from the face of the housing.

In some embodiments, one or more of the faces (e.g. the fourth face) may have a combination arrangement of hollow studs (or technic studs) and pin holes. This unique arrangement may allow attachment of bricks in two ways—directly onto the anti-studs or by inserting a pin into the pin hole and attaching a brick to the pin. In selected embodiments, interlocking-brick compatible faces may be designed as separate parts so they can be interchanged with future versions or iterations easily in the manufacturing process. (i.e. Alternative embodiments may have a face with DUPLO studs, or an accessory attachment. To accomplish this change, only those faces need to be molded and the rest of the housing may remain unchanged)

Figure 17:
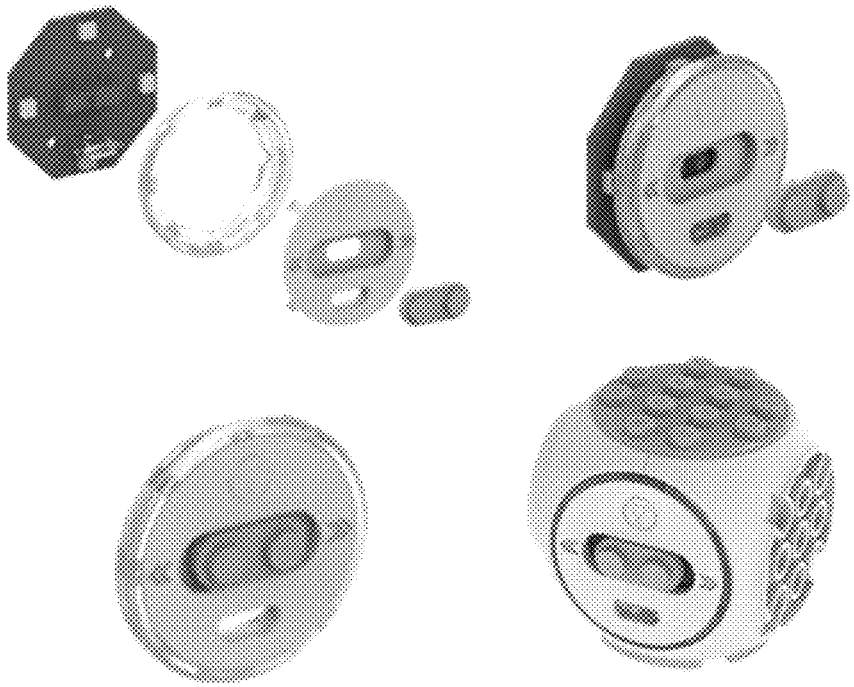
FIG. 17 shows a custom switch cap designed to fit over the switch actuator on the second face.
Figure 18:
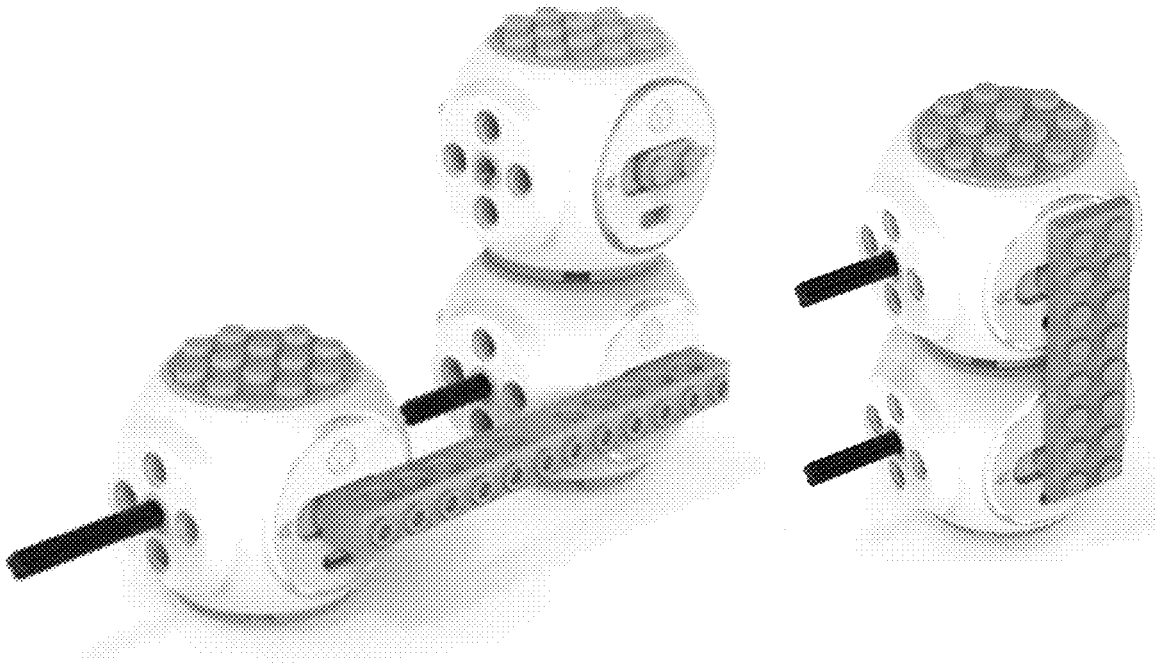
FIG. 18 shows hub-to-hub mating capability, and how multiple hubs may be controlled via their switch caps.
Figure 19A:
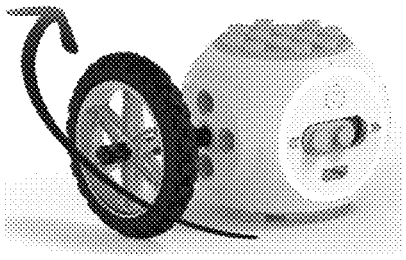
FIGS. 19A-19C show the three different positions of a switch resulting in change of rotation direction of the motor (clockwise, no rotation, and counter-clockwise).
Figure 19B:
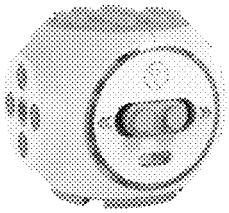
Figure 19C:
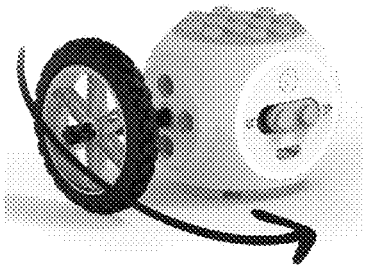
Figure 20:
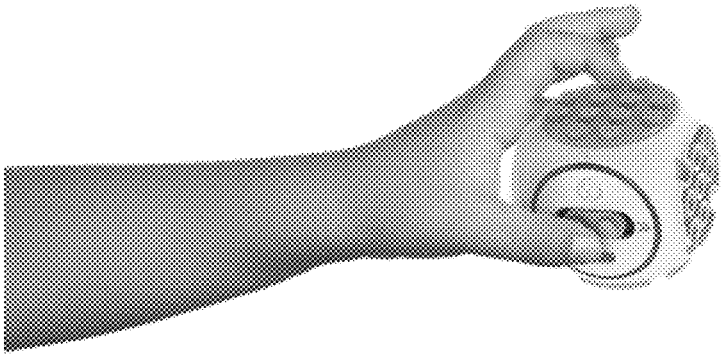
FIG. 20 shows how the hub dimensions have been sized for young learners.
Figure 21A:
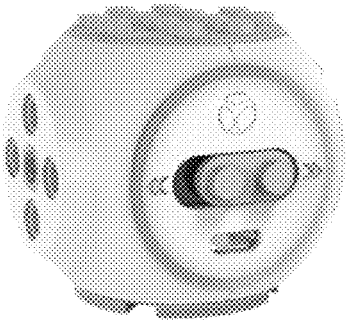
FIGS. 21A-21C shows an indicator light in "on," "off," and "low battery" states.
Figure 21B:
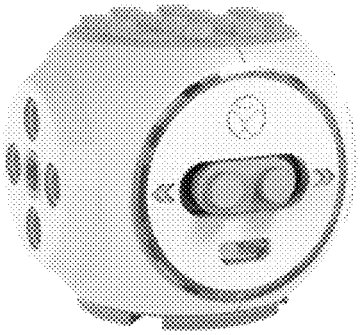
Figure 21C:
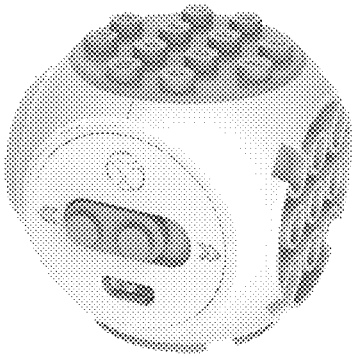
Figure 22:
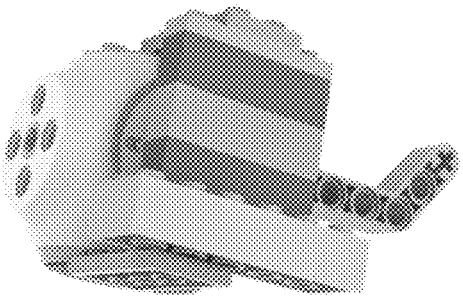
FIG. 22 shows how the LED indicator light is visible even when there are multiple bricks attached to the hub.
Figure 26:
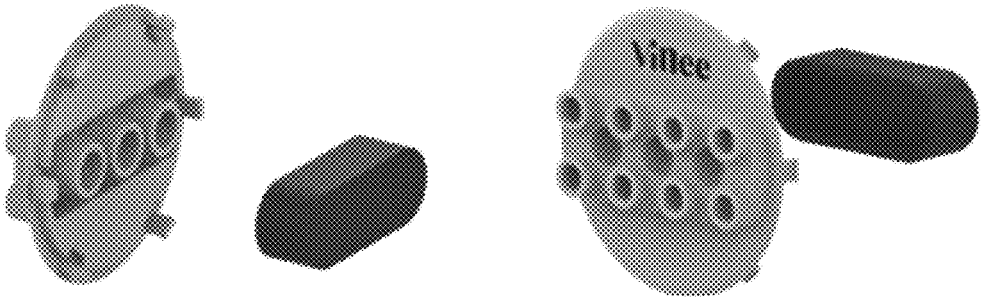
FIG. 26 shows a custom rubber cap that is placed internally behind the pinhole that protect the inner enclosure of a hub from outside elements.
Figure 27A:
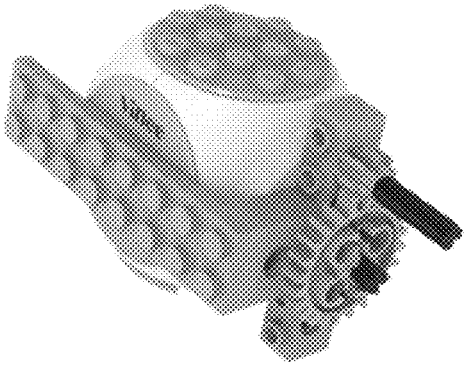
FIGS. 27A-27C show three different example options of stacking bricks on a hub of the present invention.
Figure 27B:
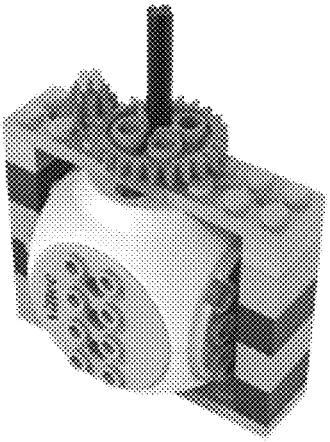
Figure 27C:
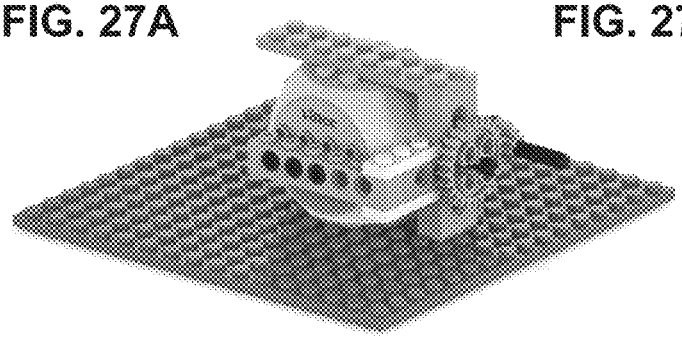
Figure 28A:
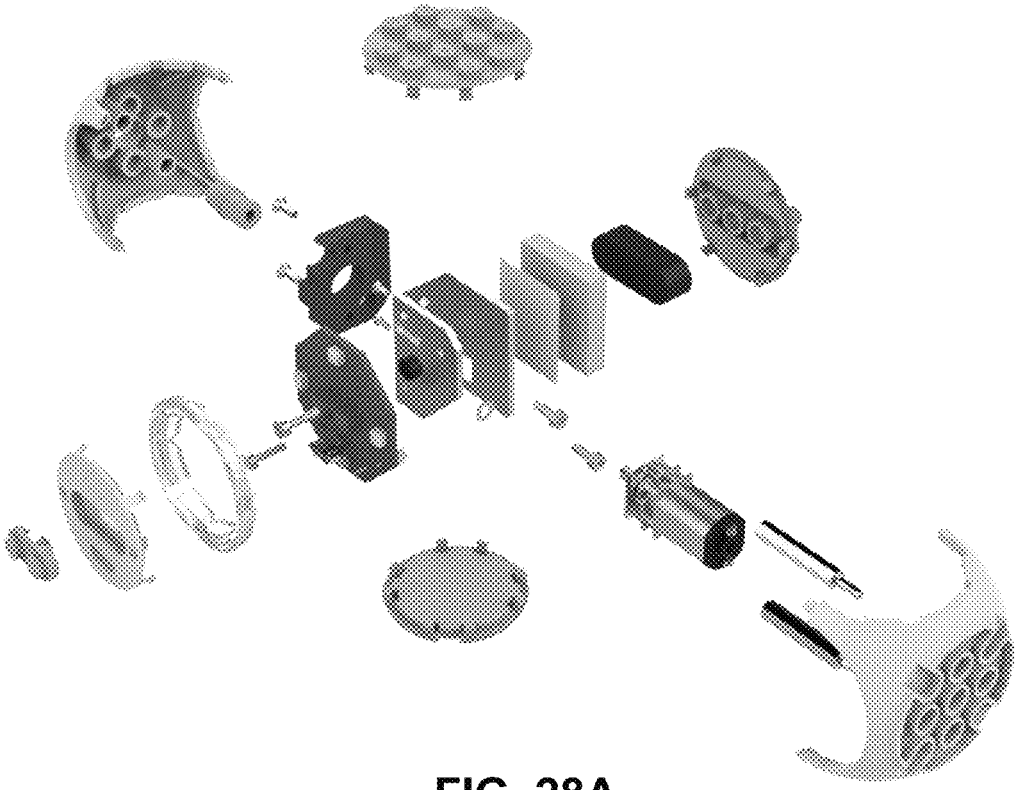
FIGS. 28A-28D show exploded views of various components of a hub of the present invention.
Figure 28B:
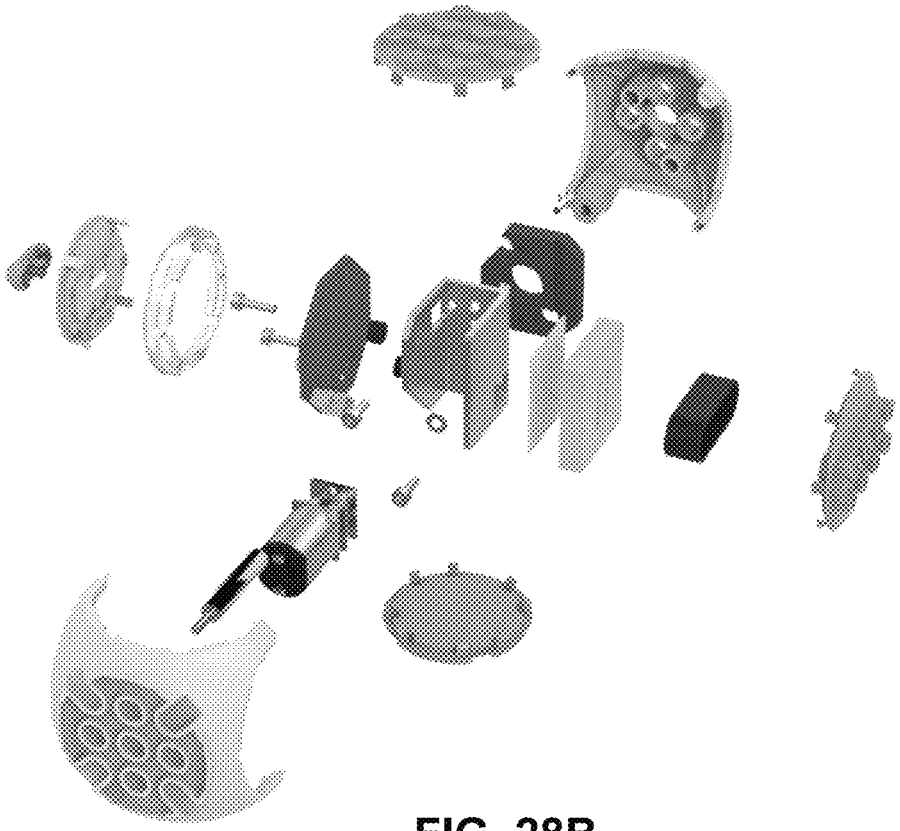
Figure 28C:
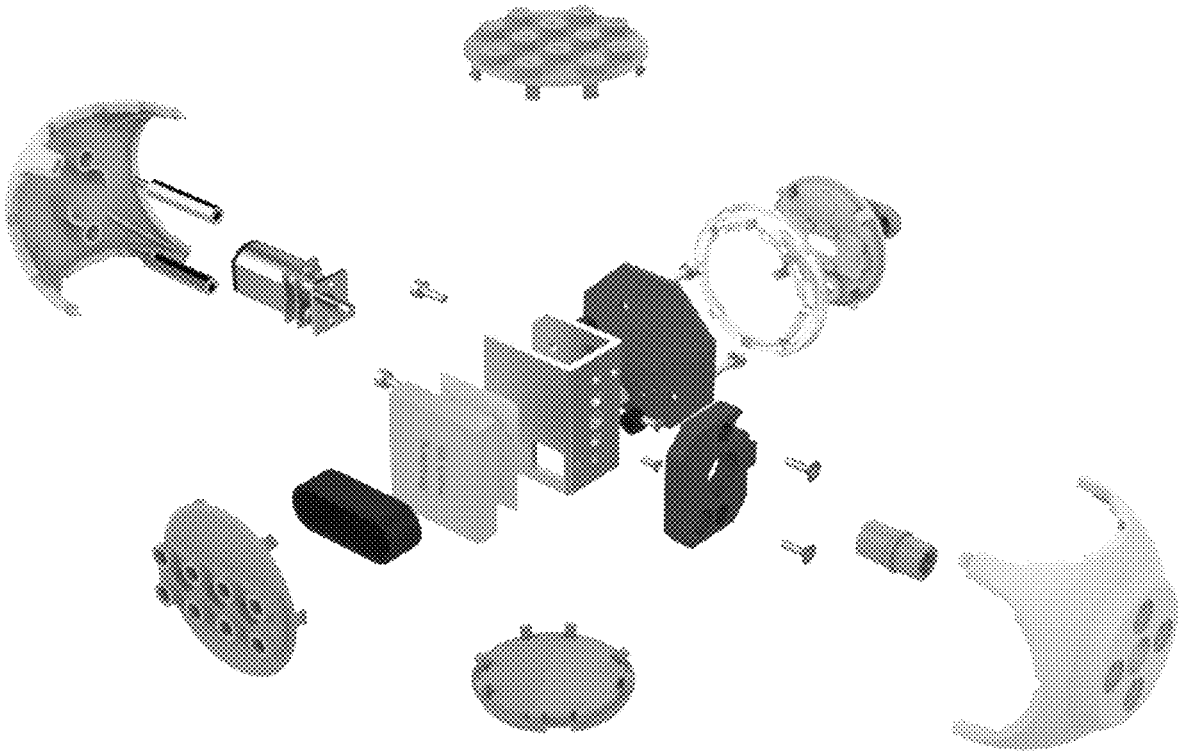
Figure 28D:
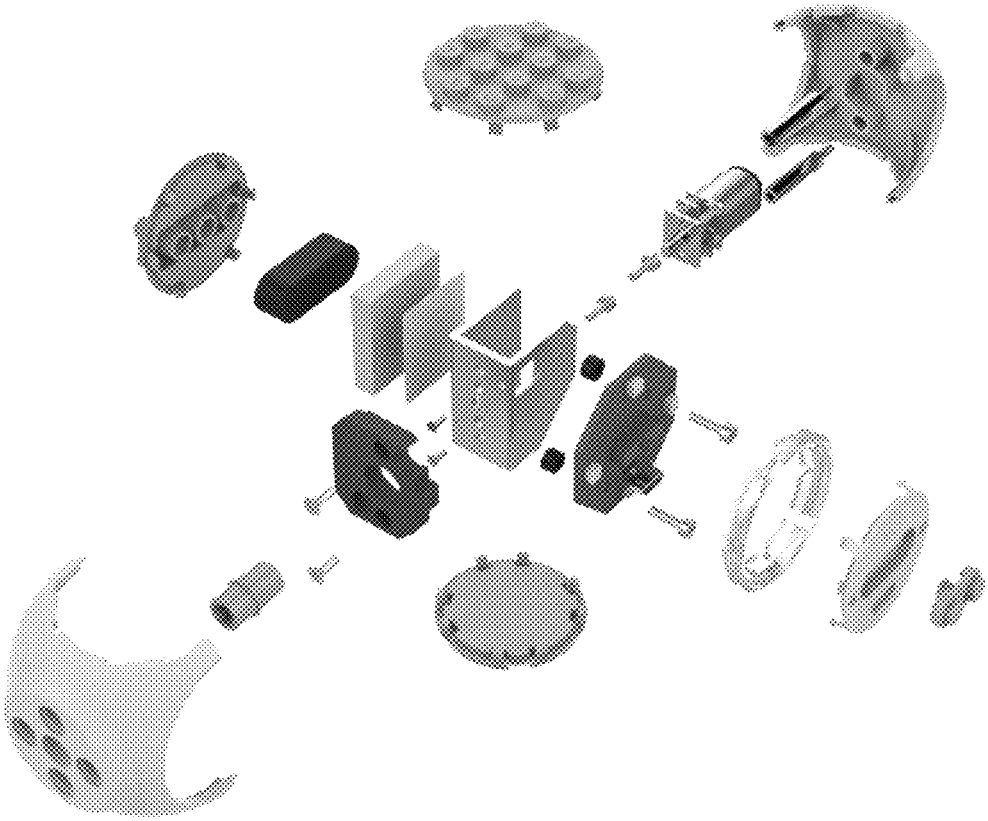

In some embodiments, the studs on face 1 may be labeled with numbers starting with 1, reading left to right, to 12. Similarly, face 2 may include Left and Right arrows corresponding with the position of the switch cap to control the motor direction clockwise or counterclockwise. As shown in FIG. 26, custom rubber caps may be placed internally behind the pinholes to protect the inner enclosure from outside elements. FIG. 17 shows a custom switch cap which may press fit on the switch actuator. This switch cap may preferably be sized large enough for easy manipulation by young children (i.e. a Large Switch cap may be designed for children's dexterity).

Figure 23:
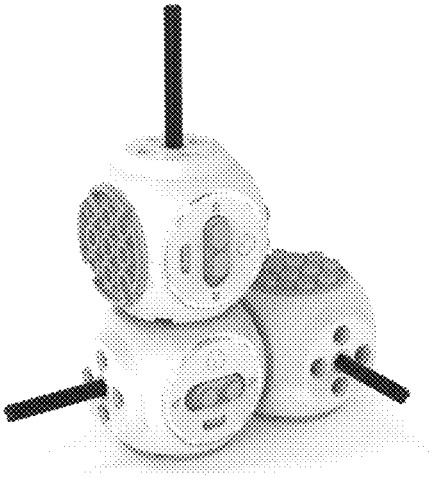
FIG. 23 shows how each axle is orthogonal to a face of a hub.
Figure 24A:
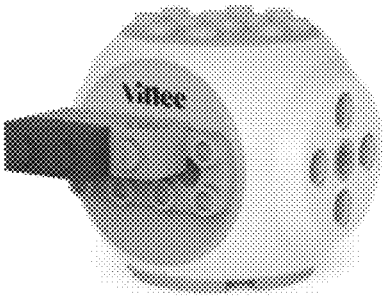
FIGS. 24A-24F show how different technic elements can be attached to the fourth face of a hub, increasing the scope and versatility of application designs.
Figure 24B:
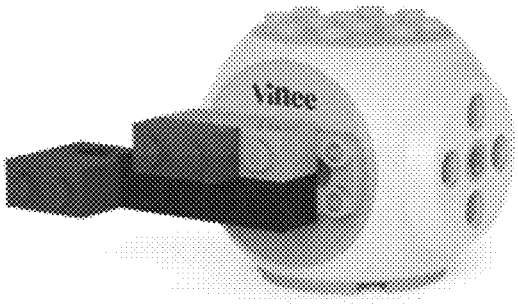
Figure 24C:
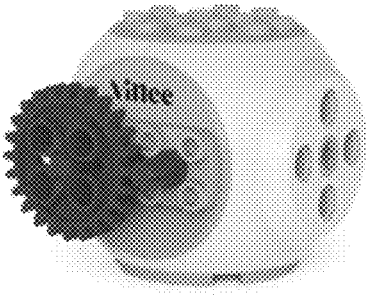
Figure 24D:
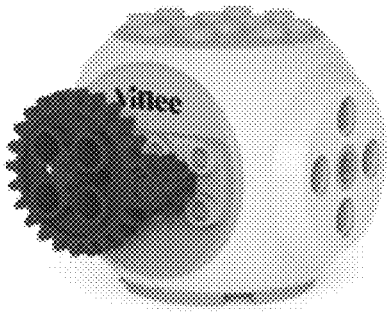
Figure 24E:
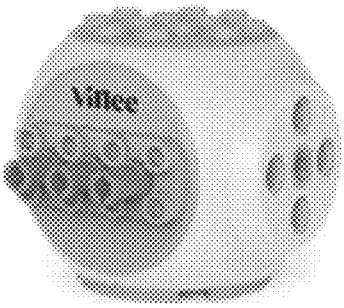
Figure 24F:
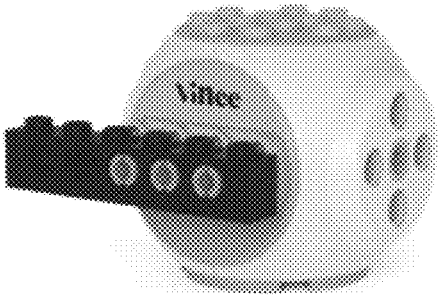
Figure 25A:
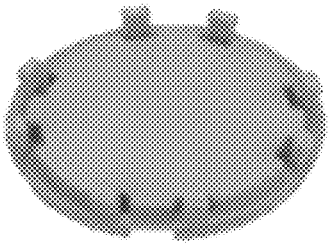
FIGS. 25A-25C show examples of the individual surface plates/faces that can be customized during manufacturing to make hubs compatible with different versions of interlocking bricks.
Figure 25B:
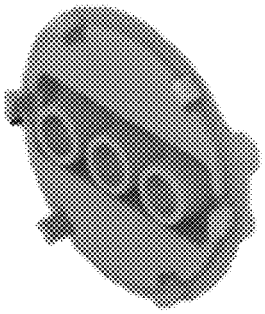
Figure 25C:
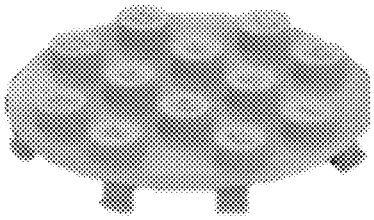

In some embodiments, various faces (e.g. Faces 5 and 6) may have different colors, so as to allow for easy differentiation. The multifaceted interlocking brick compatible surfaces may allow building blocks to be connected in a traditional parallel stacking and in perpendicular stacking. Additionally, multiple hubs can be interlocked together for product-product mating. (See FIG. 23).

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A power hub for use with interlocking bricks; the hub comprising:

a. a six-faced housing comprising:

i. a first face, disposed at a top of the housing, wherein the first face comprises 12 studs arranged in a cross pattern configured to interlock with interlocking bricks;

ii. a second face, disposed at a side of the housing such that it is perpendicular with the first face, wherein the second face comprises a control switch;

iii. a third face at a side of the housing such that it is perpendicular with the first face and the second face, wherein the third face comprises an internal driveshaft which is orthogonal to the third face and 4 pin holes arranged surrounding the driveshaft;

iv. a fourth face at a side of the housing such that it is perpendicular with the first face and the third face, and parallel with the second face wherein the fourth face comprises 8 hollow studs arranged in two rows of four and surrounding 3 pin holes, such that the fourth face is configured to receive both interlocking bricks and pins;

v. a fifth face at a side of the housing such that it is perpendicular with the first face, the second face, and the fourth face, and parallel with the third face, wherein the fifth face comprises 5 anti-studs arranged in a cross pattern; and vi. a sixth face, disposed at a bottom of the housing such that it is perpendicular with the second face, the third face, the fourth face, and the fifth face, and parallel with the first face, wherein the sixth face comprises 5 anti-studs arranged in a cross pattern, surrounded by 4 recesses radially extending from the anti-studs, each recess having a closed curved end and an open opposing end;

b. an electric motor, disposed inside the housing and mechanically coupled with the driveshaft such that the motor is configured to cause rotation of the driveshaft; and c. an internal battery, disposed inside the housing and electrically coupled with the motor such that the battery is configured to power the motor, wherein the switch is electrically coupled with both the motor and the battery such that the switch is configured to control operation of the motor.

* * * * *